US011489288B2

(12) United States Patent
Hartman et al.

(10) Patent No.: US 11,489,288 B2
(45) Date of Patent: Nov. 1, 2022

(54) CONNECTOR RETENTION CLIP

(71) Applicant: Raytheon Company, Waltham, MA (US)

(72) Inventors: Ryan M. Hartman, Tucson, AZ (US); James F. Morris, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/006,655

(22) Filed: Aug. 28, 2020

(65) Prior Publication Data

US 2022/0069523 A1 Mar. 3, 2022

(51) Int. Cl.

| | |
|---|---|
| ***H01R 13/639*** | (2006.01) |
| ***H01R 12/71*** | (2011.01) |
| ***H01R 13/508*** | (2006.01) |
| ***H01R 13/58*** | (2006.01) |
| ***H01R 24/76*** | (2011.01) |

(52) U.S. Cl.

CPC ..... *H01R 13/639* (2013.01); *H01R 12/716* (2013.01); *H01R 13/508* (2013.01); *H01R 13/58* (2013.01); *H01R 24/76* (2013.01)

(58) Field of Classification Search

CPC ..... H01R 13/639; H01R 13/6397; H01R 13/508; H01R 13/58; H01R 13/5804; H01R 12/716; H01R 24/76; H01R 13/5213; H01R 13/5066

See application file for complete search history.

(56) References Cited

U.S. PATENT DOCUMENTS

| | | | | |
|---|---|---|---|---|
| 4,169,643 | A | 10/1979 | Gallagher | |
| 5,569,049 | A * | 10/1996 | Tatebe | H01R 24/50 439/394 |
| 6,338,653 | B1 | 1/2002 | Jones et al. | |
| 6,483,035 | B2 | 11/2002 | Hasegawa et al. | |
| 7,285,725 | B1 | 10/2007 | Saman | |
| 7,648,371 | B2 | 1/2010 | Boensch et al. | |
| 7,857,668 | B2 | 12/2010 | Henderson | |
| 7,988,490 | B2 | 8/2011 | Chen et al. | |
| RE43,427 | E | 5/2012 | Dawiedczyk et al. | |

(Continued)

FOREIGN PATENT DOCUMENTS

| | | |
|---|---|---|
| CN | 111555082 A | 8/2020 |
| JP | 2009-158357 A | 7/2009 |

OTHER PUBLICATIONS

International Search Report for International Application No. PCT/US2021/039458 dated Oct. 11, 2021, 43 pages.

*Primary Examiner* — Briggitte R. Hammond

(57) ABSTRACT

A connector retention clip is disclosed. The connector retention clip can include a connector housing having a plurality of connector walls defining a connector opening operable to receive a coupled receptacle and plug connector therein. The plurality of connector walls can include a receptacle end wall and a plug end wall operable to extend about ends of the receptacle and plug, respectively, to provide a mechanical barrier preventing uncoupling of the coupled receptacle and plug connector. In addition, the connector retention clip can include a cable housing extending from the connector housing. The cable housing can have at least one cable wall defining a cable opening operable to receive a cable therein that extends from the coupled receptacle and plug connector.

18 Claims, 4 Drawing Sheets

(56) References Cited

U.S. PATENT DOCUMENTS

| | | | | |
|---|---|---|---|---|
| 8,491,328 | B2 | 7/2013 | Mulfinger et al. | |
| 8,734,179 | B2 * | 5/2014 | Tsai | H01R 4/48 439/394 |
| D720,701 | S | 1/2015 | Hiscoke | |
| 8,926,363 | B2 | 1/2015 | Klein et al. | |
| D725,046 | S | 3/2015 | Kuo | |
| 9,147,973 | B1 * | 9/2015 | Madison | H01R 13/6395 |
| 9,461,426 | B2 | 10/2016 | Armacost et al. | |
| 9,509,089 | B2 | 11/2016 | Mathews et al. | |
| 9,520,664 | B2 | 12/2016 | Schrader | |
| 9,825,414 | B2 * | 11/2017 | Armstrong | H01R 13/447 |
| D860,141 | S * | 9/2019 | Cyzen | D13/156 |
| 10,454,214 | B1 | 10/2019 | Sato | |
| 2018/0226736 | A1 | 8/2018 | Hirakawa | |
| 2019/0239340 | A1 | 8/2019 | Trulli et al. | |

* cited by examiner

CONNECTOR RETENTION CLIP

GOVERNMENT LICENSE RIGHTS

This invention was made with government support under contract HQ0727-19-F-1611 awarded by the United States Defense Microelectronics Activity (DMEA). The government has certain rights in the invention.

BACKGROUND

Plug and receptacle connectors mounted on circuit boards (e.g., wire harness "plugs" and multi-pin surface mounted "receptacles") are in widespread use for a variety of different applications. Such connectors often include "built-in" or integrated locking mechanisms designed to maintain engagement of the plugs and receptacles. Some connectors, however, are subjected to high accelerations in use. In such cases, the built-in locking mechanisms may be inadequate to maintain connection of the plugs and receptacles. As a result, various chemical adhesives have been utilized to keep plug and receptacle connectors from separating.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
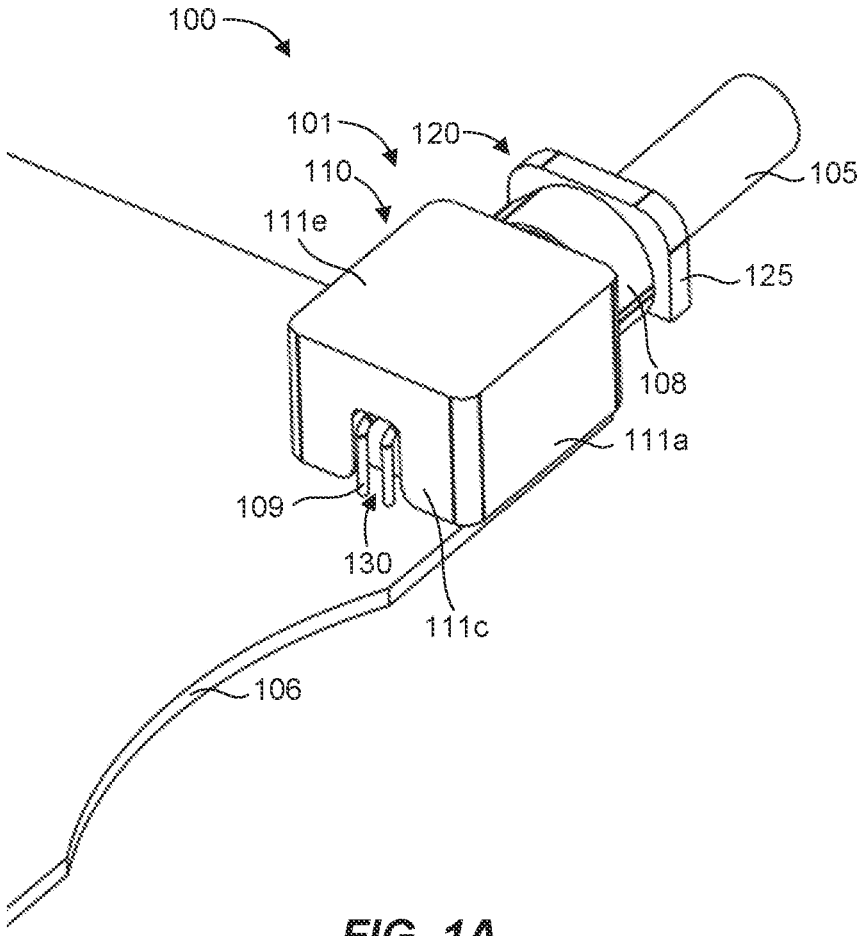
FIG. 1A is a front perspective view of a connector retention clip system in accordance with an example of the present disclosure.
Figure 1B:
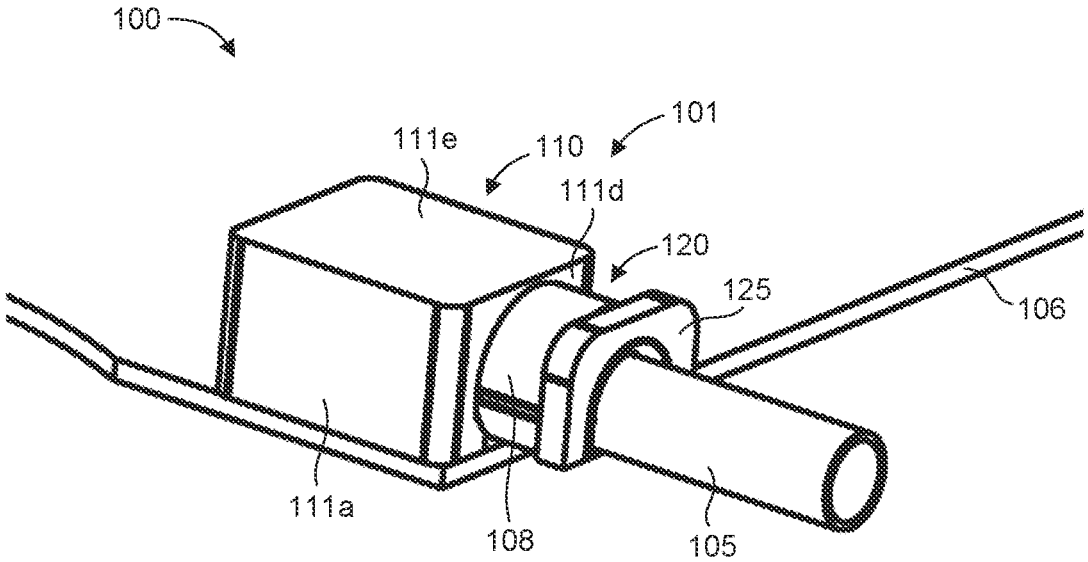
FIG. 1B is a rear perspective view of the connector retention clip system of FIG. 1A.
Figure 1C:
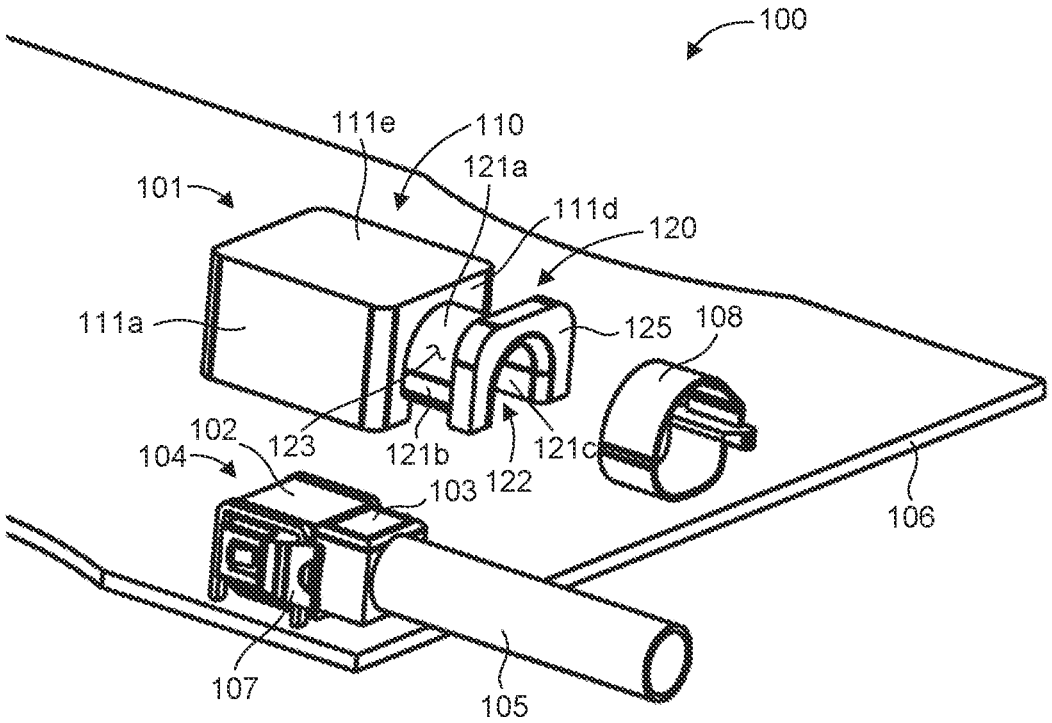
FIG. 1C is an exploded view of the connector retention clip system of FIG. 1A.
Figure 2A:
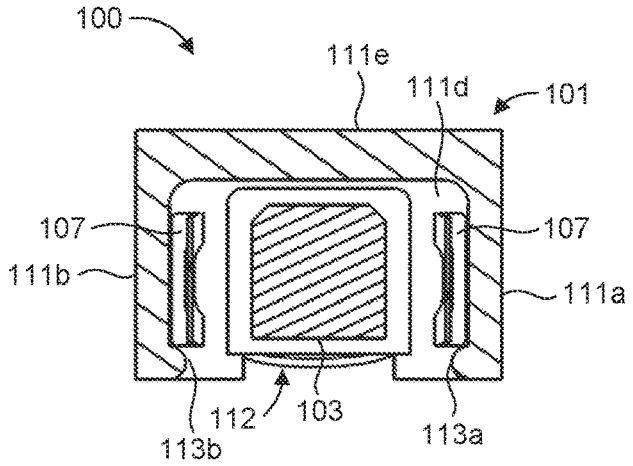
FIGS. 2A-2C are cross-sectional views of the connector retention clip system of FIG. 1A.
Figure 2B:
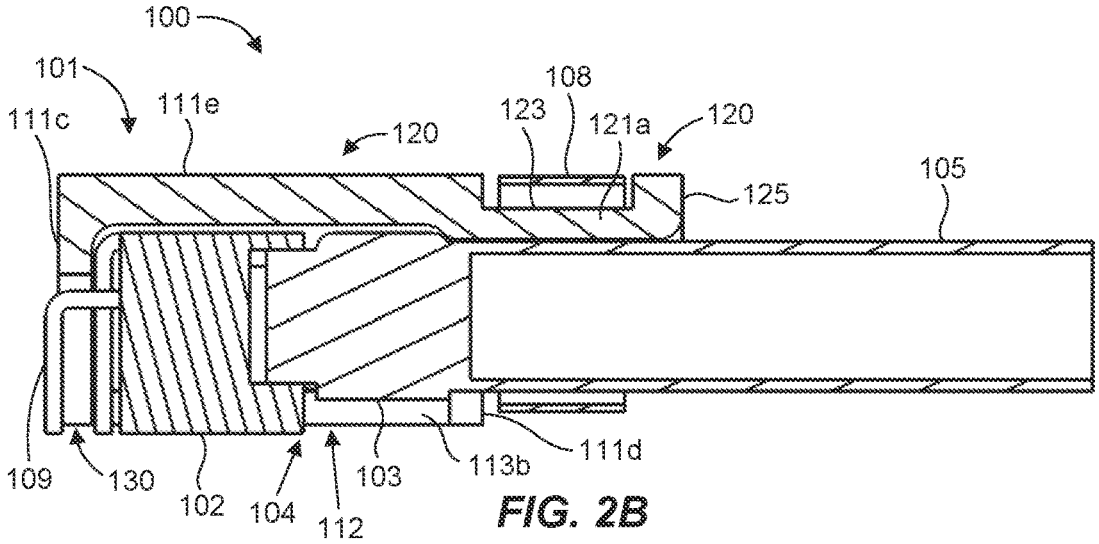
Figure 2C:
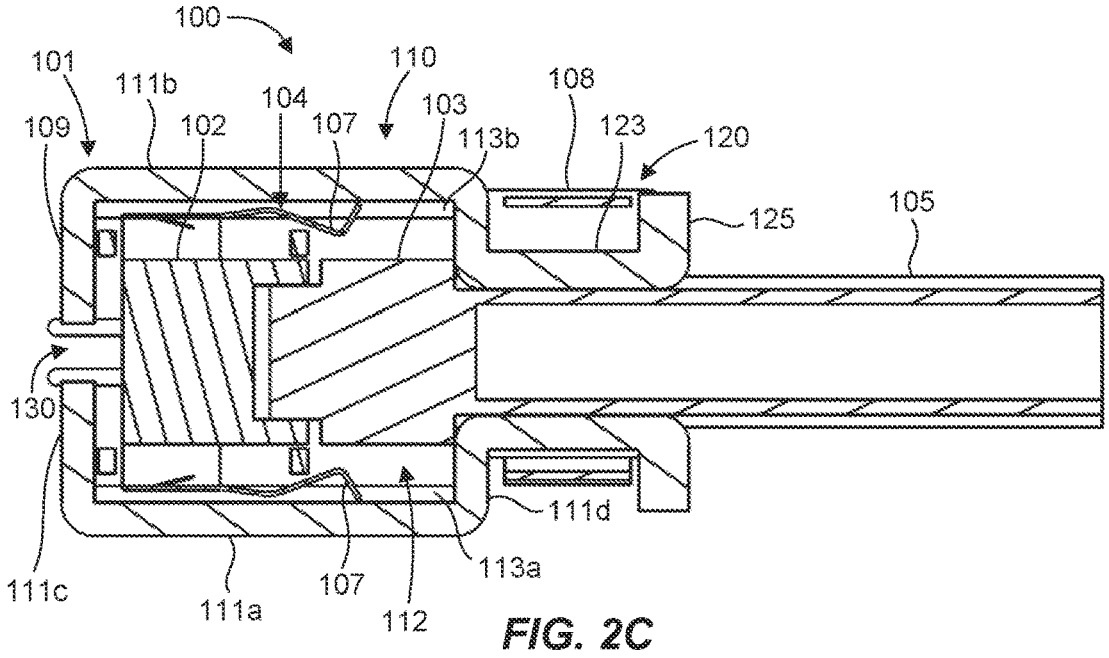

Reference will now be made to the exemplary embodiments illustrated, and specific language will be used herein to describe the same. It will nevertheless be understood that no limitation of the scope of the invention is thereby intended.

DETAILED DESCRIPTION

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

Although adhesives may be functional to maintain connection of plug and receptacle connectors, use of adhesives does have drawbacks. Chemical adhesives are messy and may be hazardous to equipment and personnel. In addition, removing old adhesive and applying new adhesive is difficult and time-consuming, which increases downtime and expense for service and maintenance.

Accordingly, a connector retention clip is disclosed that can be quickly and easily secured about a plug and receptacle connector and that prevents disconnection during high acceleration loading conditions. The connector retention clip can include a connector housing having a plurality of connector walls defining a connector opening operable to receive a coupled receptacle and plug connector therein. The plurality of connector walls can include a receptacle end wall and a plug end wall operable to extend about ends of the receptacle and plug, respectively, to provide a mechanical barrier preventing uncoupling of the coupled receptacle and plug connector. In addition, the connector retention clip can include a cable housing extending from the connector housing. The cable housing can have at least one cable wall defining a cable opening operable to receive a cable therein that extends from the coupled receptacle and plug connector.

A connector retention clip system is disclosed that can include a receptacle and a plug coupled to one another to form a coupled receptacle and plug connector having a cable extending therefrom. The connector retention clip system can also include a connector retention clip operably associated with the coupled receptacle and plug connector to prevent the receptacle and the plug from uncoupling. The connector retention clip can comprise a connector housing having a plurality of connector walls defining a connector opening. The coupled receptacle and plug connector can be received within the connector opening. The plurality of connector walls can include a receptacle end wall and a plug end wall extending about ends of the receptacle and plug, respectively, to provide a mechanical barrier preventing uncoupling of the coupled receptacle and plug connector. Additionally, the connector retention clip can comprise a cable housing extending from the connector housing. The cable housing can have at least one cable wall defining a cable opening. The cable can be received within the cable opening.

To further describe the present technology, examples are now provided with reference to the figures. With reference to FIGS. 1A-2C, one example of a connector retention clip system 100 is illustrated. In general, the connector retention clip system 100 can comprise a connector retention clip 101 and a receptacle 102 and a plug 103 coupled to one another to form a coupled receptacle and plug connector 104 having a cable 105 extending from the plug 103 (as in the illustrated example) or the receptacle 102. The connector retention clip 101 is shown isolated in FIGS. 3A and 3B. The connector retention clip 101 can be operably associated with the coupled receptacle and plug connector 104 to prevent the receptacle 102 and the plug 103 from uncoupling or disconnecting during use. The receptacle 102 and the plug 103 can be of any suitable type or configuration known in the art (e.g., a mating wire harness and multi-pin connector). In one aspect, the system 100 can include a circuit board 106, and the receptacle 102 or the plug 103 can be operably attached to the circuit board 106. In some examples, the receptacle 102 (as in the illustrated example) or the plug 103 can be surface mounted to the circuit board 106.

In some examples, the receptacle 102 and/or the plug 103 can include a locking mechanism 107 designed to maintain engagement or connection of the receptacle 102 and the plug 103. However, operating conditions (e.g., high acceleration loading) may be such that the locking mechanism 107 is inadequate to maintain engagement or connection of the receptacle 102 and the plug 103. As described in more detail below, the connector retention clip 101 can provide a secure and robust device for maintaining engagement or connection of the receptacle 102 and the plug 103 under even extreme operating and loading conditions.

The connector retention clip 101 can include a connector housing 110 having connector walls 111*a-e* that define a connector opening 112 (FIGS. 2A-2C and 3B). The coupled receptacle and plug connector 104 can be received within the connector opening 112. The connector housing 110 can have any suitable shape or configuration to accommodate the shape or geometry of the coupled receptacle and plug connector 104. The connectors walls 111*a-e* can have any suitable shape or configuration (e.g., planar, curved, curvilinear, etc.) to define a desired connector opening 112 shape or volume. In addition, any suitable number of connector walls 111*a-e* can be utilized. In the illustrated example, the connector housing 110 has a cuboid configuration formed by five connector walls 111*a-e*. In one aspect, the connector walls 111*a-e* can include a receptacle end wall 111*c* and a plug end wall 111*d* that extend about ends of the receptacle 102 and the plug 103, respectively, to provide a mechanical barrier preventing uncoupling of the coupled receptacle and plug connector 104. In addition, side walls 111*a*, 111*b* and a top wall 111*e* can couple the end walls 111*b*, 111*c* to one another and provide structural support for the end walls 111*b*, 111*c*. In one aspect, the side walls 111*a*, 111*b* can be configured to provide a mechanical barrier to a releasing (e.g., outward) movement by the locking mechanism 107 (FIG. 2C) to maintain engagement of the built-in locking features and add another layer of security to the locking mechanism 107. Thus, the connector housing 110 can be configured to surround and captivate the coupled receptacle and plug connector 104 to ensure that the receptacle 102 and the plug 103 remain connected under high loading conditions.

In one aspect, the connector housing 110 can include at least one protrusion 113*a*, 113*b* (FIGS. 2A-2C and 3B) extending inward from at least one of the connector walls 111*a-e* over a portion of the connector opening 112. In other words, the at least one protrusion 113*a*, 113*b* can at least partially extend under or "undercut" structures of the coupled receptacle and plug connector 104 to maintain the clip 101 properly in place about the coupled receptacle and plug connector 104. In the illustrated example, the protrusions 113*a*, 113*b* extend inward from side walls 111*a*, 111*b*, respectively. The connector walls 111*a-e* (individually or collectively in any combination) can be formed so as to comprise a degree of compliance sufficient to enable the coupled receptacle and plug connector 104 to move past the protrusions 113*a*, 113*b* and be received within the connector opening 112. In other words, the protrusions 113*a*, 113*b* can provide a "snap-fit" for the clip 101 over the coupled receptacle and plug connector 104. The protrusions 113*a*, 113*b* can be operable to provide a mechanical barrier to movement of the coupled receptacle and plug connector 104 out of the connector opening 112. Thus, the protrusions 113*a*, 113*b* can serve to maintain the clip 101 properly in place about the coupled receptacle and plug connector 104.

The at least one protrusion 113*a*, 113*b* can have any suitable shape, geometry, or configuration in accordance with the principles disclosed herein. For example, the protrusions 113*a*, 113*b* can have a rounded tip to facilitate fitting the clip 101 over the coupled receptacle and plug connector 104. In addition, as shown in the illustrated example, the protrusions 113*a*, 113*b* can extend at least partially along a length of the side walls 111*a*, 111*b*. In other examples, the at least one protrusion 113*a*, 113*b* can be configured as a pin, a lip, a shoulder, a flange, or any other suitable configuration. In a particular aspect, the at least one protrusion 113*a*, 113*b* can be configured to fit between a given structure of the coupled receptacle and plug connector 104 and the circuit board 106, as applicable, to enable securing the clip 101 over the coupled receptacle and plug connector 104.

Figure 3A:
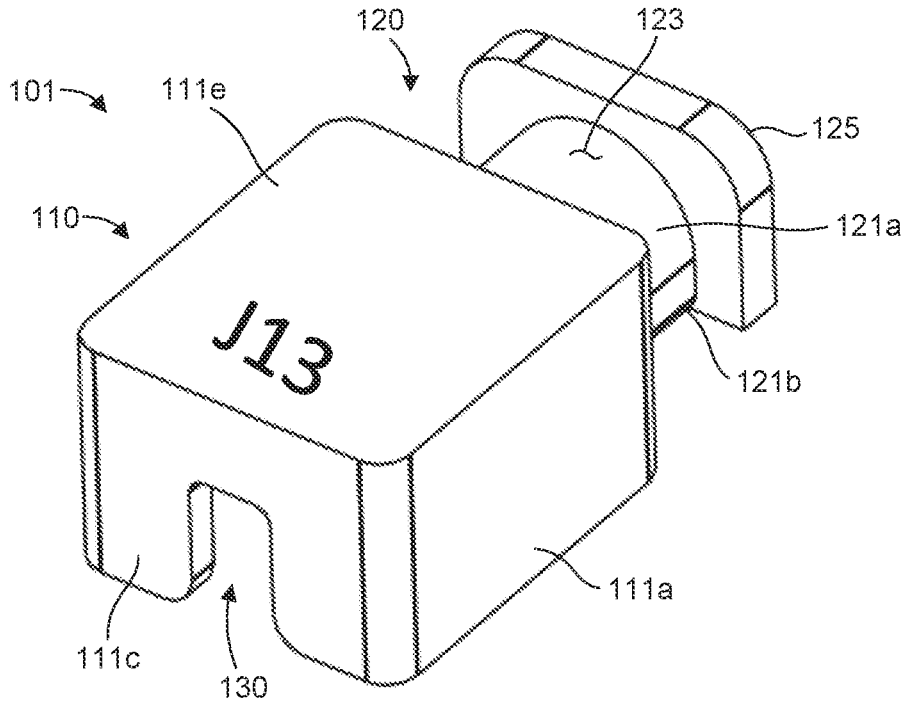
FIG. 3A is a top perspective view of a connector retention clip in accordance with an example of the present disclosure.
Figure 3B:
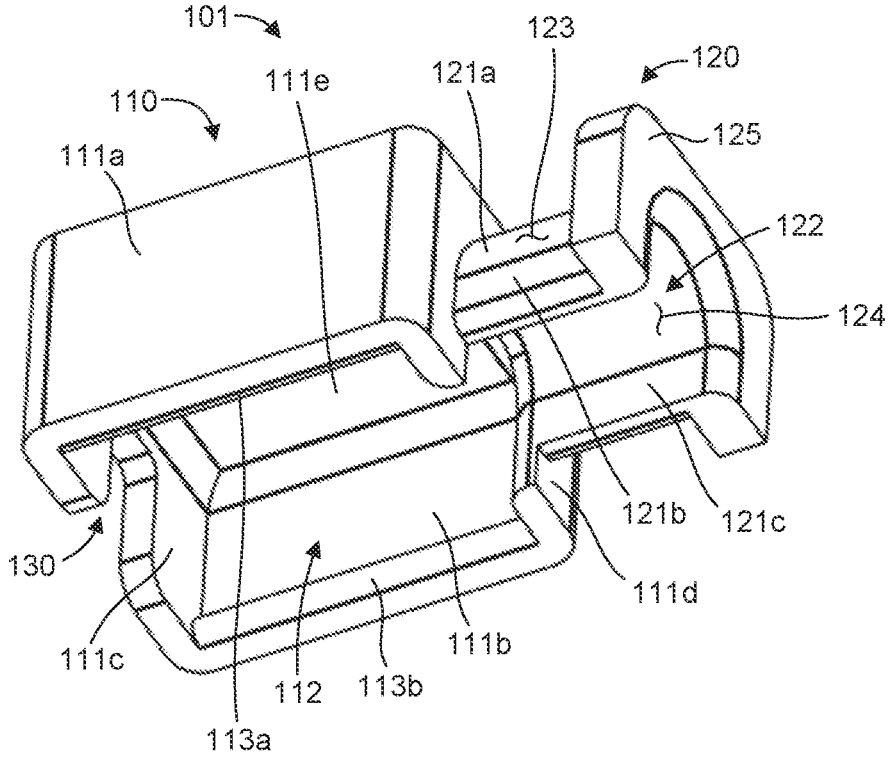
FIG. 3B is a bottom perspective view of the connector retention clip of FIG. 3A.

The connector retention clip 101 can also include a cable housing 120 extending from the connector housing 110. The cable housing 120 can have at least one cable wall 121*a-c* (FIGS. 10, 3A, and 3B) that defines a cable opening 122 (FIGS. 10 and 3B). The cable 105 can be received within the cable opening 122. In one aspect, the system 100 can include a cable tie 108 (FIGS. 1A-2C), which can maintain the cable 105 in the cable opening 122 and therefore serve to maintain the clip 101 properly in place about the coupled receptacle and plug connector 104. An outer surface 123 (FIGS. 1C and 2B-3B) of the cable wall 121*a-c* can be operable to interface with the cable tie 108 to secure the cable 105 within the cable opening 122. In some examples, the cable housing 120 can include a flange 125 (FIGS. 1A-1C and 2B-3B) extending outward from the cable wall 121*a-c*. The flange 125 can be operable to maintain the cable tie 108 in a given position on or relative to the outer surface 123. The cable wall 121*a-c* can have any suitable configuration. In some examples, at least a portion of the cable housing (e.g., as defined by the outer surface 123 and/or an inner surface 124) can have a semi-circular cross-section, or any other cross-sectional shape or geometry to complement the cable 105. In some examples, the cable wall 121*a-c* (e.g., the inner surface 124) can comprise a cable opening 122 smaller than the diameter of the cable 105, such that the cable housing 120 can be configured to provide a snap-fit around the cable 105 as an alternative or in addition to the function provided by the cable tie 108 in maintaining the cable 105 in the cable opening 122. In one aspect, the cable housing 120 and optional cable tie 108 can also serve to provide strain relief for the cable 105 by providing additional support about the cable 105, which restricts its motion relative to the either the receptacle 102 or the plug 103, whichever it is connected to. In addition, the clip 101 can reduce strain on the mechanical and/or electrical coupling features (e.g. interconnects 109, such as contacts or pins) that couple the receptacle 102 or the plug 103 to the circuit board 106 by reducing cable movement in relation to the plug 103 and the receptacle 102. Thus, in some examples, the protrusions 113*a*, 113*b* and cable tie 108 can keep the clip 101 secure about the coupled receptacle and plug connector 104, and the cable housing 120 and the cable tie 108 can protect the cable 105 by providing strain relief for the cable 105 and interconnects 109. The clip 101 can therefore serve as a connection retention device for the coupled receptacle and plug connector 104 as well as provide protection for the cable 105.

In some examples, the connector retention clip 101 can include an interconnect opening 130 in at least one of the connector walls 111*a-e* operable to accommodate an interconnect 109 that electrically couples the receptacle 102 or the plug 103 to the circuit board 106. In the illustrated example, the interconnect opening 130 is located in the receptacle end wall 111*c*, although one or more interconnect openings can be formed or located in any suitable connector wall, such as in the plug end wall 111*d* or the side walls 111*a*, 111*b*, as applicable.

In some examples, the clip 101 (e.g., the connector housing 110 and the cable housing 120) can form a single, monolithic structure, although multiple, separate individual components can be combined or otherwise coupled to one another to form the clip 101. The clip 101 can be made of any suitable material (e.g., polymer, metal, composite, etc.) and can be constructed utilizing any suitable process (e.g., molding, machining, etc.). In one aspect, the clip 101 can be manufactured using an additive manufacturing process (e.g., 3D printing), which can provide a low cost, user friendly, and highly customizable retention clip that can be designed and produced quickly when needed. In another aspect, the clip 101 can be manufactured using an injection molding process for mass production and reduced costs.

The clip 101 can further comprise markings or other indicia (see optional indicia 140 in FIG. 3A) supported on or formed in the connector housing 110, such as one or more of the connector walls 111*a-e*, or on the cable housing 120. The markings or indicia can be operable to provide identifying or other information related to the clip 101 itself, the receptacle 102, the plug 103, to a location on the circuit board 106, or any combination of these. The indicia can be caused to be supported on one or more of the connector walls 111*a-e* using any known means or method. In one example, the indicia can be printed onto the one or more of the connector walls 111*a-e*. In another example, the indicia can be formed via a cut-out or other material reduction of a portion of one or more of the connector walls 111*a-e* (e.g., a recessed portion, a through-hole, etc.) made during manufacturing. In still another example, the indicia can be supported on a medium that can be applied to one or more of the connector walls 111*a-e* (e.g., an adhesive sticker or other stick on medium). FIG. 3A illustrates the clip 101 comprising indicia indicating "J13" on the connector wall 111*e*, which represents, or is indicative of, the type of connector, size of connector, etc. This is not intended to be limiting in any way as those skilled in the art will recognize other types of markings or indicia that can be supported on the clip 101.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A connector retention clip comprising:

a connector housing having a plurality of connector walls defining a connector opening operable to receive a coupled receptacle and plug connector therein, the plurality of connector walls including a receptacle end wall and a plug end wall operable to extend about ends of the receptacle and plug, respectively, to provide a mechanical barrier preventing uncoupling of the coupled receptacle and plug connector; and a cable housing extending from the connector housing, the cable housing having at least one cable wall defining a cable opening operable to receive a cable therein that extends from the coupled receptacle and plug connector;

wherein the connector housing further comprises at least one protrusion extending inward from at least one of the plurality of connector walls over a portion of the connector opening, the at least one of the plurality of connector walls being compliant sufficient to enable the coupled receptacle and plug connector to move past the at least one protrusion and be received within the connector opening, and the at least one protrusion being operable to provide a mechanical barrier to movement of the coupled receptacle and plug connector out of the connector opening.

2. The connector retention clip of claim 1, wherein the at least one of the plurality of connector walls comprises a side wall, and the at least one protrusion extends inward from the side wall.

3. The connector retention clip of claim 1, wherein an outer surface of the at least one cable wall is operable to interface with a cable tie to secure the cable within the cable opening.

4. The connector retention clip of claim 3, wherein the cable housing further comprises a flange extending outward from the at least one cable wall, wherein the flange is operable to maintain the cable tie on the outer surface.

5. The connector retention clip of claim 1, further comprising an interconnect opening in at least one of the plurality of connector walls operable to accommodate an interconnect that electrically couples the receptacle or plug to a circuit board.

6. The connector retention clip of claim 5, wherein the interconnect opening is formed in at least one of the receptacle end wall or the plug end wall.

7. The connector retention clip of claim 1, wherein the connector housing and the cable housing form a single, monolithic structure.

8. The connector retention clip of claim 1, wherein the connector housing has a cuboid configuration.

9. The connector retention clip of claim 1, wherein at least a portion of the cable housing has a circular cross-section.

10. A connector retention clip system comprising:

a receptacle and a plug coupled to one another to form a coupled receptacle and plug connector having a cable extending therefrom; and a connector retention clip operably associated with the coupled receptacle and plug connector to prevent the receptacle and the plug from uncoupling, the connector retention clip comprising:

a connector housing having a plurality of connector walls defining a connector opening, the coupled receptacle and plug connector being received within the connector opening, the plurality of connector walls including a receptacle end wall and a plug end wall extending about ends of the receptacle and plug, respectively, to provide a mechanical barrier preventing uncoupling of the coupled receptacle and plug connector, and a cable housing extending from the connector housing, the cable housing having at least one cable wall defining a cable opening, the cable being received within the cable opening;

wherein the connector housing further comprises at least one protrusion extending inward from at least one of the plurality of connector walls over a portion of the connector opening, the at least one of the plurality of connector walls being compliant sufficient to enable the coupled receptacle and plug connector to move past the at least one protrusion and be received within the connector opening, and the at least one protrusion being operable to provide a mechanical barrier to movement of the coupled receptacle and plug connector out of the connector opening.

11. The system of claim 10, wherein the at least one of the plurality of connector walls comprises a side wall, and the at least one protrusion extends inward from the side wall.

12. The system of claim 10, further comprising a cable tie interfacing with an outer surface of the at least one cable wall to secure the cable within the cable opening, and the cable housing further comprises a flange extending outward from the at least one cable wall, wherein the flange is operable to maintain the cable tie on the outer surface.

13. The system of claim 10, wherein the receptacle or the plug is surface mounted to a circuit board.

14. The system of claim 10, further comprising indicia supported on the connector retention clip.

15. A connector retention clip comprising:

a connector housing having a plurality of connector walls defining a connector opening operable to receive a coupled receptacle and plug connector therein, the plurality of connector walls including a receptacle end wall and a plug end wall operable to extend about ends of the receptacle and plug, respectively, to provide a mechanical barrier preventing uncoupling of the coupled receptacle and plug connector;

a cable housing extending from the connector housing, the cable housing having at least one cable wall defining a cable opening operable to receive a cable therein that extends from the coupled receptacle and plug connector, wherein an outer surface of the at least one cable wall is operable to interface with a cable tie to secure the cable within the cable opening, and wherein the cable housing further comprises a flange extending outward from the at least one cable wall, wherein the flange is operable to maintain the cable tie on the outer surface; and an interconnect opening in at least one of the plurality of connector walls operable to accommodate an interconnect that electrically couples the receptacle or plug to a circuit board;

wherein the interconnect opening is formed in at least one of the receptacle end wall or the plug end wall.

16. The connector retention clip of claim 15, wherein the connector housing further comprises at least one protrusion extending inward from at least one of the plurality of connector walls over a portion of the connector opening, the at least one of the plurality of connector walls being compliant sufficient to enable the coupled receptacle and plug connector to move past the at least one protrusion and be received within the connector opening, and the at least one protrusion being operable to provide a mechanical barrier to movement of the coupled receptacle and plug connector out of the connector opening.

17. The connector retention clip of claim 15, wherein at least one of the plurality of connector walls comprises a side wall, and the at least one protrusion extends inward from the side wall.

18. The connector retention clip of claim 15, wherein the connector housing and the cable housing form a single, monolithic structure.

* * * * *